US007104760B2

(12) United States Patent
Burdgick

(10) Patent No.: US 7,104,760 B2
(45) Date of Patent: Sep. 12, 2006

(54) HYBRID BUCKET AND RELATED METHOD OF POCKET DESIGN

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 168 days.

(21) Appl. No.: 10/838,693

(22) Filed: May 5, 2004

(65) Prior Publication Data

US 2005/0249601 A1 Nov. 10, 2005

(51) Int. Cl.
*F01D 5/16* (2006.01)

(52) U.S. Cl. ..... 416/224; 416/229 A; 416/500

(58) Field of Classification Search ..... 416/229 A, 416/223 A, 224, 500
See application file for complete search history.

(56) References Cited

U.S. PATENT DOCUMENTS 5,720,597 A 2/1998 Wang et al. ..... 416/229 A
5,931,641 A 8/1999 Finn et al. ..... 416/229 A
5,947,688 A 9/1999 Schilling et al.
6,033,186 A 3/2000 Schilling et al.
6,039,542 A * 3/2000 Schilling et al. ..... 416/229 A
6,042,338 A 3/2000 Brafford et al.
6,139,278 A * 10/2000 Mowbray et al. ..... 416/229 A
6,287,080 B1 9/2001 Evans et al. ..... 416/229 A
2002/0164253 A1* 11/2002 von Flotow ..... 416/500

OTHER PUBLICATIONS

U.S. Appl. No. 10/249,518, filed Apr. 16, 2003, entitled "Mixed Tuned Hybrid Bucket and Related Method".

* cited by examiner

*Primary Examiner*—Edward K. Look
*Assistant Examiner*—Richard A. Edgar
(74) *Attorney, Agent, or Firm*—Nixon & Vanderhye P.C.

(57) ABSTRACT

A steam turbine rotor wheel includes a plurality of blades secured about a circumferential periphery of the wheel, each blade comprising a shank portion and an airfoil portion, the airfoil portion having at least one pocket filled with a filler material, wherein at least one edge of the pocket adjacent a leading edge of the blade is formed with an undercut.

14 Claims, 5 Drawing Sheets

HYBRID BUCKET AND RELATED METHOD OF POCKET DESIGN

BACKGROUND OF THE INVENTION

This invention relates generally to steam turbine buckets (or blades) and, more particularly, to the adhesion of filler material in hybrid or composite blades.

Steam turbine blades operate in an environment where they are subject to high centrifugal loads and vibratory stresses. Vibratory stresses increase when blade natural frequencies become in resonance. The magnitude of vibratory stresses when a blade vibrates in resonance is proportional to the amount of damping present in the system (damping to a smaller or greater degree is achieved via materials and the aerodynamic and mechanical components), as well as the vibration stimulus level.

At the same time, centrifugal loads are a function of the operating speed, the mass of the blade, and the radius from engine centerline where that mass is located. As the mass of the blade increases, the physical area or cross-sectional area must increase at lower radial heights to be able to carry the mass above it without exceeding the allowable stresses for the given material. This increasing section area of the blade at lower spans contributes to excessive flow blockage at the root and thus lower performance. The weight of the blade also contributes to higher disk stresses and thus potentially to reduced reliability.

Several prior U.S. patents relate to so-called "hybrid" blade designs where the airfoil portion of the metal blade is formed with one or more pockets filled with a polymer (or polymer/metal, glass or ceramics mix) filler material. These prior patents include U.S. Pat. Nos. 6,287,080; 6,139,278; 6,042,338; 6,039,542; 6,033,186; 5,947,688; 5,931,641 and 5,720,597. See also co-pending commonly owned application Ser. No. 10/249,518, filed Apr. 16, 2003. One area not addressed by the prior work in this area is the problem of achieving more reliable adhesion of the filler within the pocket or pockets formed in the airfoil portion of the blade.

More specifically, the large incidence angles of steam flow to the bucket surface could cause the cast polymer filler to delaminate from the pocket formed in the airfoil portion of the blade. In other words, the large angle of incidence of the steam flow to the bucket surface exposes a higher risk of the flow tending to "lift" the filler material off the pocketed surface.

BRIEF DESCRIPTION OF THE INVENTION

This invention proposes an edge geometry along one or more edges of the pocket formed in the airfoil portion of the blade in order to improve adhesion of the filler at the interface, specifically in the high angle of incidence steam flow field. While this invention utilizes the hybrid blade concept as disclosed, for example, in U.S. Pat. No. 5,931,641, that concept is extended to include optimization of pocket shape within the airfoil portions of the blades in order to improve adhesion of the filler material.

In the exemplary embodiment, the marginal area of the pocket, and preferably the marginal edge of the pocket extending along the leading edge of the blade, is formed with an "undercut." This undercut serves the purpose of not allowing the high angle of incidence steam flow from trying to "lift" the polymer (or polymer/metal mix) filler from the pocket. The undercut thus shields that portion of the filler/bucket interface with the highest angle of incidence to the incoming steam flow. The undercut could also be extended, however, to include the trailing edge or even all edges of the pocket or pockets.

Accordingly, in its broader aspects, the invention relates to a steam turbine rotor wheel comprising a plurality of blades secured about a circumferential periphery of the wheel, each blade comprising a shank portion and an airfoil portion, the airfoil portion having at least one pocket filled with a filler material, wherein at least one edge of the pocket adjacent a leading edge of the blade is formed with an undercut.

In another aspect, the invention relates to a steam turbine rotor wheel comprising a row of blades secured about a circumferential periphery of the wheel, each blade formed with one or more pockets filled with a filler material and where at least an edge of the pocket adjacent a leading edge of the airfoil incorporates means for enhancing adhesion of the filler material to the blade.

In still another aspect, the present invention relates to a turbine blade comprising a shank portion and an airfoil portion, the airfoil portion having at least one pocket filled with a filler material, wherein at least one edge of the pocket adjacent a leading edge of the blade is formed with an undercut.

The invention will now be described in detail in connection with the drawings identified below.

DETAILED DESCRIPTION OF THE INVENTION

Figure 1:
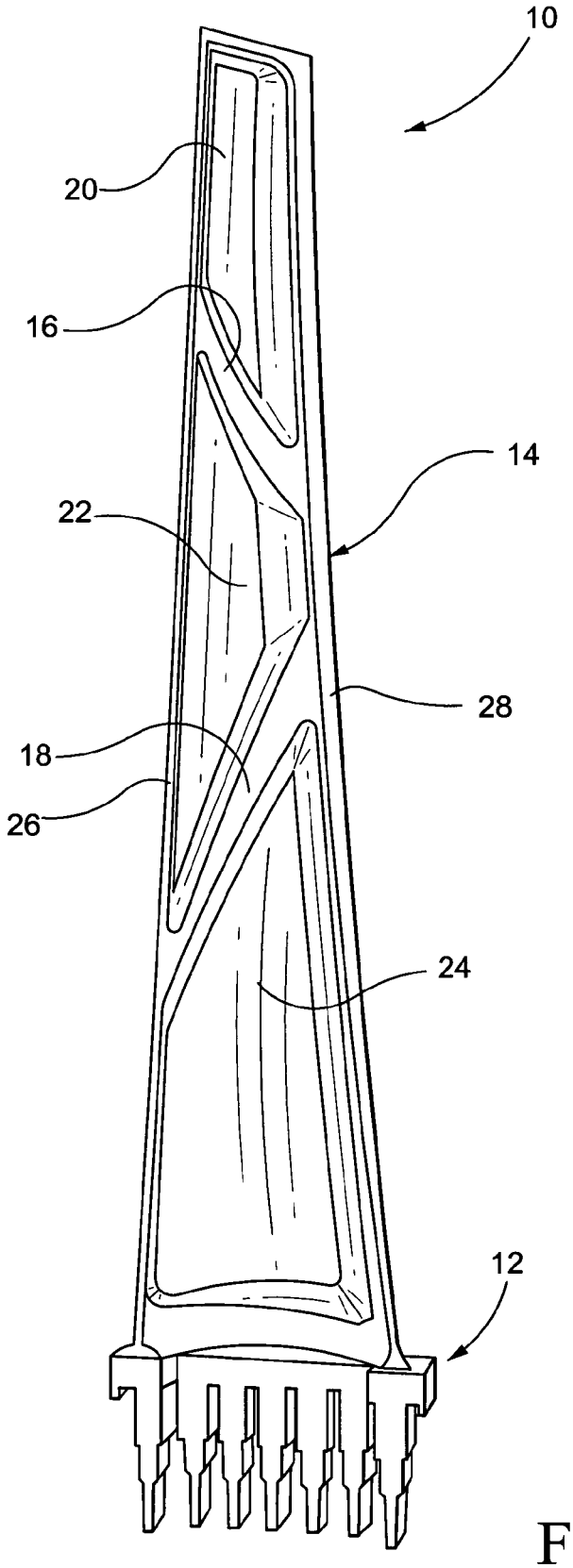
Fig. 1 (PRIOR ART)
FIG. 1 is a perspective view of a partially manufactured blade illustrating an unfilled pocket configuration in the airfoil portion of the blade.
Figure 2:
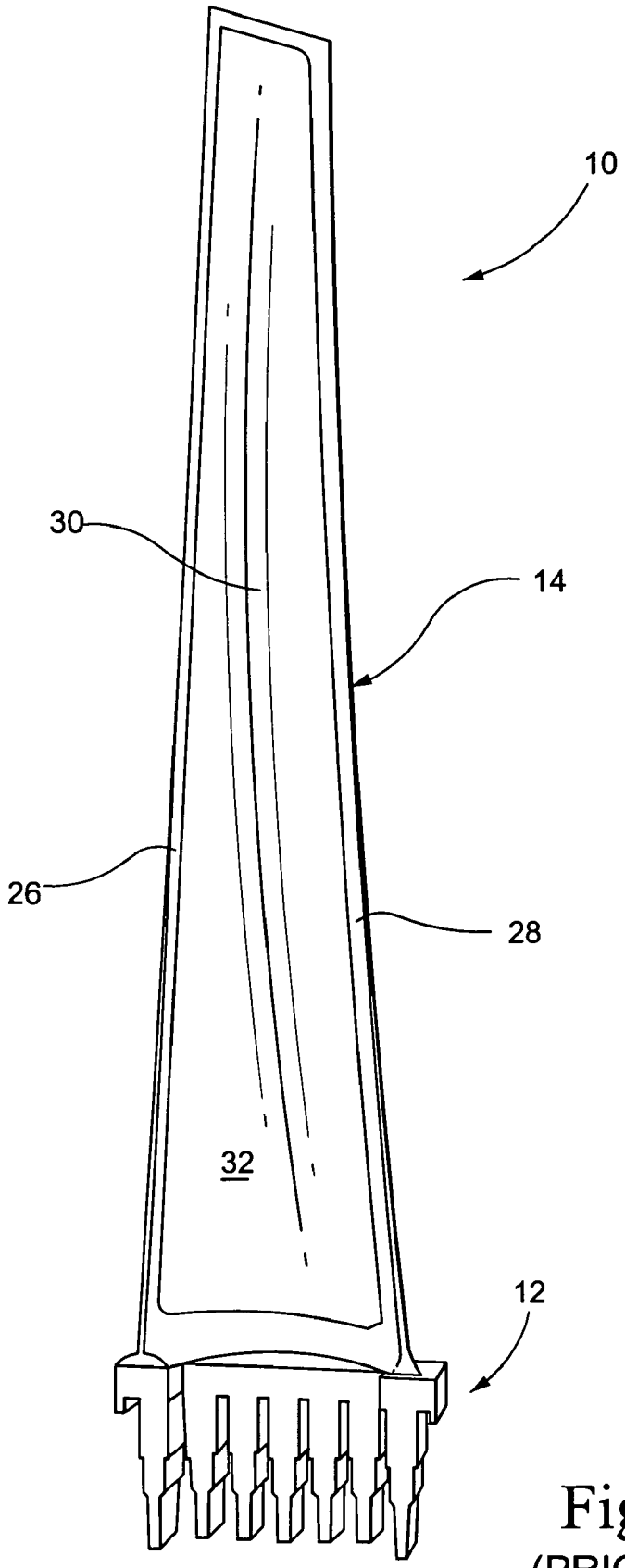
Fig. 2 (PRIOR ART)
FIG. 2 is a similar view of the blade in FIG. 1 but after filler material has been applied over the pockets.

With reference to FIG. 1, a steam turbine blade 10 is shown in partially manufactured form. The blade 10 includes a shank portion 12 and an airfoil portion 14. The airfoil portion is preferably constructed of steel or titanium but other suitable materials include aluminum, cobalt or nickel. Ribs 16, 18 are integrally cast with the airfoil portion to form discrete pockets 20, 22 and 24. It will be appreciated, however, that the ribs do not extend flush with the side edges 26, 28 of the airfoil portion. The rib height may in fact vary according to specific applications. A polymer based (or polymer/metal, glass or ceramics mix) filler material 30 as described, for example, in U.S. Pat. Nos. 6,287,080 and 5,931,641 is cast-in-place over the pressure side of the airfoil, filling the pockets 20, 22 and 24 and covering the ribs to thereby form a smooth face 32 on the pressure side of the bucket, as shown in FIG. 2.

Figure 3:
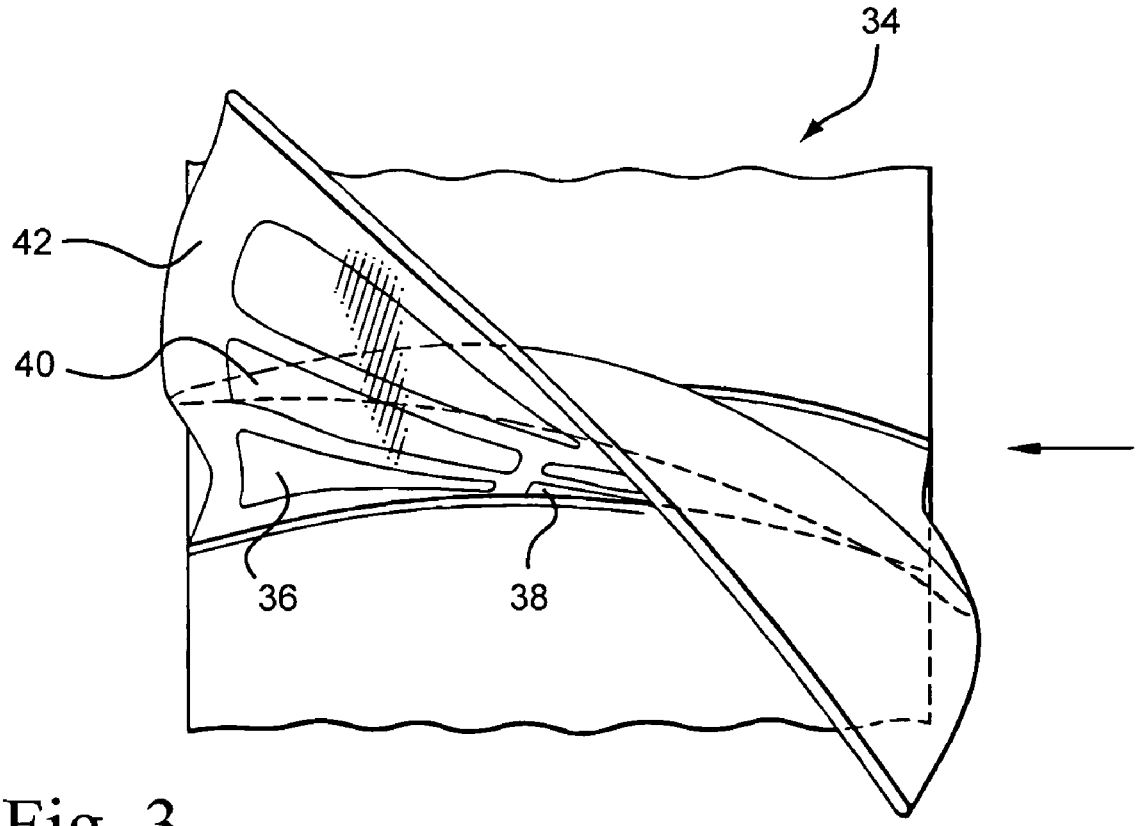
Fig. 3 (PRIOR ART)
FIG. 3 is a partial plan view of another hybrid blade illustrating multiple filled pockets along the airfoil portion of the blade.
Figure 4:
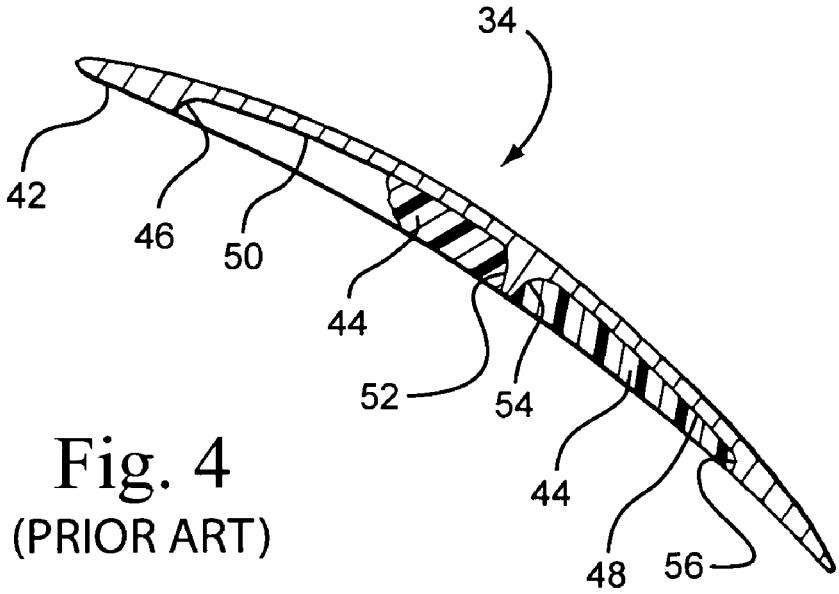
Fig. 4 (PRIOR ART)
FIG. 4 is a cross-sectional view of the blade shown in FIG. 3.

FIGS. 3 and 4 illustrate another known hybrid blade construction where the blade 34 is formed with a plurality of discrete pockets 36, 38, 40, etc. along the pressure side of the airfoil portion 42 of the blade. In this arrangement, filler material 44 (FIG. 4) is cast in each pocket individually, with the filler material flush with the surrounding airfoil surfaces. As a result, each discrete pocket is externally visible. FIG. 4 also illustrates the conventional practice of forming the pockets 46, 48 with side surfaces 50, 52 and 54, 56 that curve radially outwardly (at an oblique angle to the adjacent airfoil surface) at the interface with the exterior surface of the airfoil portion.

Figure 5:
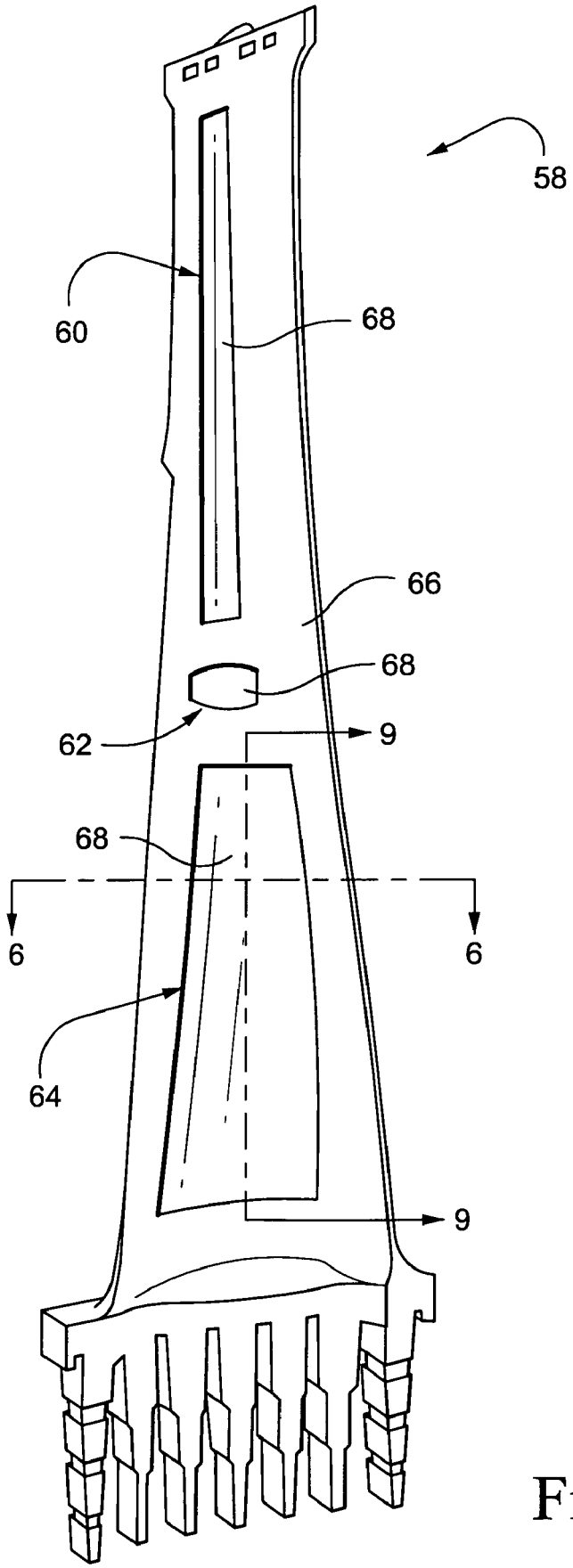
FIG. 5 is an elevation of a hybrid blade constructed in accordance with the exemplary embodiment of this invention.
Figure 6:
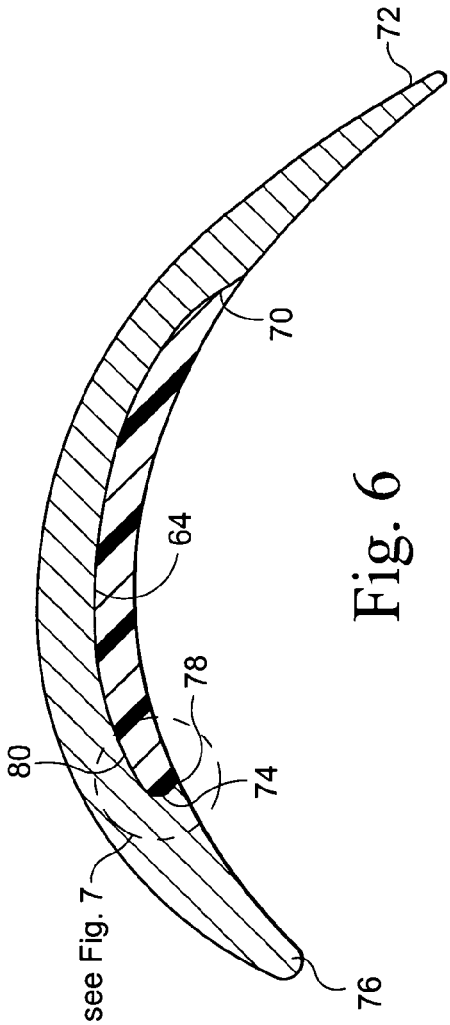
FIG. 6 is a section taken along the line 6—6 in FIG. 5.
Figure 7:
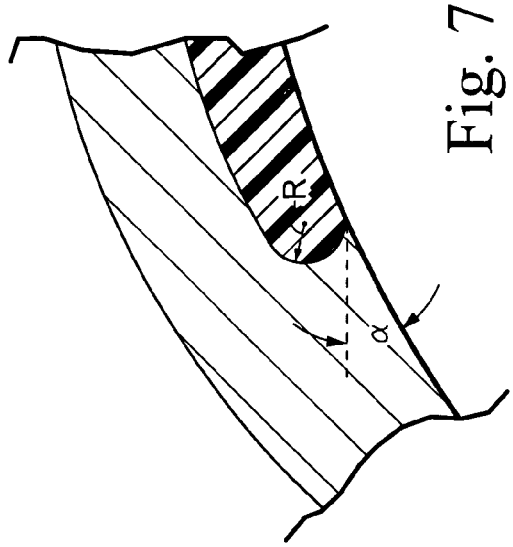
FIG. 7 is an enlarged detail taken from FIG. 6.

Currently, available choices for bonding the filler material 30 or 44 to the metal surface of the airfoil portion include, without limitation, self adhesion, adhesion between the filler material 30 or 44 and the metal surface of the airfoil portion, adhesive bonding (adhesive film or paste), and fusion bonding. As discussed above, however, these adhesion techniques may not be sufficient to prevent delamination of the filler along that part of the filler-blade interface exposed to large angle of incidence steam flow. In accordance with an exemplary embodiment of this invention, and with reference to FIGS. 5 and 6, adhesion of the filler is enhanced by the incorporation of an undercut along some or all of the edges of the pocket. Referring initially to FIG. 5, the blade 58 is formed with three polymer-filled pockets 60, 62 and 64 on the pressure side 66 of the airfoil portion of the blade. Filler material 68 is shown cast-in-place, with the filler material flush with the surrounding airfoil surface. As shown in FIG. 6, the pocket 64 is defined by an edge 70 closest to the trailing edge 72 of the bucket that smoothly interfaces with the external surface of the airfoil, in accordance with the prior practice. The pocket edge 74 closest to the leading edge 76, however, is now formed with an undercut 78 that creates an acute angle $\alpha$ at the interface with the adjacent airfoil surface, as best seen in FIG. 7. The undercut itself may be formed of a small or large radius R depending upon the thickness of the airfoil near the leading edge, and the radius is gradually blended into the back wall 80 of the pocket in such a way as to reduce the concentrated stress due to the undercut geometry. It will be understood that the manner of application as well as the composition of the filler material may be in accordance with current practice.

Figure 9:
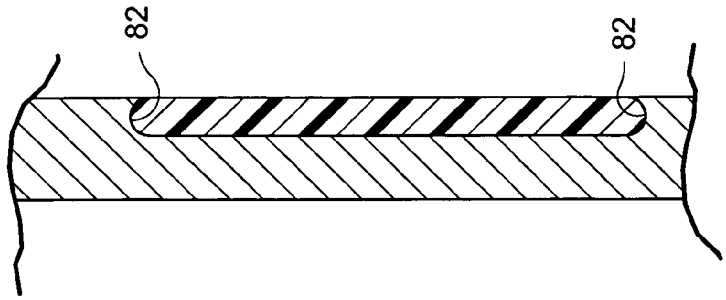
FIG. 9 is a section taken along the line 9—9 of FIG. 5, illustrating undercuts on the radially inner and outer edges of the airfoil filler pocket.
Figure 8:
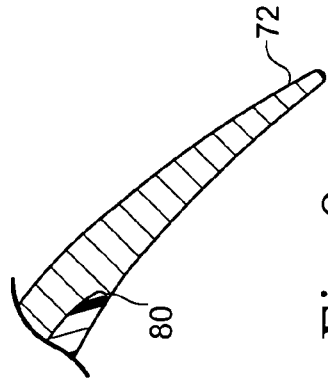
FIG. 8 is a partial cross-section of the trailing edge of a hybrid blade with an undercut similar to that shown in FIG. 7.

It will also be appreciated that the overall configuration of the pocket may vary as desired, and that the invention here relates primarily to the incorporation of an undercut along the marginal edges of the one or more pockets, and especially along the edge closest to (or adjacent to) the leading edge of the bucket where the filler material interfaces with the adjacent external surface on the pressure side of the bucket. The undercut could, however, be extended to include the pocket edge closest to (or adjacent to) the trailing edge of the bucket (see undercut 80 in FIG. 8), or even to include all edges of the one or more pockets (see undercut 82 in FIG. 9 which extends about the entire periphery of the pocket). As described above, the incorporation of an undercut prevents the steam flow from causing delamination of the pocket fill material at the most vulnerable location, i.e., along the leading edge of the airfoil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A metal steam turbine blade comprising a shank portion and an airfoil portion, said airfoil portion having at least one pocket filled with a filler material including a non-metallic material, wherein at least one edge of the pocket adjacent a leading edge of the blade is formed with an undercut defined by a radius that intersects an adjacent airfoil surface at an acute angle.

2. The metal steam turbine blade of claim 1 wherein the undercut is formed along a second edge of the pocket adjacent a trailing edge of the blade.

3. The metal steam turbine blade of claim 1 wherein said undercut is formed along an entire peripheral edge of said pocket.

4. The metal steam turbine blade of claim 1 wherein said filler material comprises a polymer.

5. The metal steam turbine blade of claim 1 wherein said blade is titanium and said polymer filler material comprises poly (dimethylsiloxane).

6. The metal steam turbine blade of claim 1 wherein said filler material comprises a mix of polymer and metal, glass or ceramics.

7. The metal steam turbine blade of claim 6 wherein the airfoil portion has a plurality of pockets formed therein.

8. The metal steam turbine blade of claim 6 wherein said at least one pocket is formed on a pressure side of said airfoil portion.

9. A steam turbine rotor wheel comprising a plurality of blades secured about a circumferential periphery of the wheel, each blade comprising a shank portion and an airfoil portion, said airfoil portion having at least one pocket filled with a filler material, wherein at least one edge of the pocket adjacent a leading edge of the blade is formed with an undercut defined by a radius that intersects an adjacent airfoil surface at an acute angle.

10. The steam turbine rotor wheel of claim 9 wherein the undercut is formed along a second edge of the pocket adjacent a trailing edge of the blade.

11. The steam turbine rotor wheel of claim 9 wherein said undercut is formed along an entire peripheral edge of said pocket.

12. The steam turbine rotor wheel of claim 11 wherein said filler material comprises a polymer-based material.

13. The steam turbine rotor wheel of claim 11 wherein said filler material comprises a mix of polymer and metal, glass or ceramics.

14. The steam turbine rotor wheel of claim 9 wherein said at least one pocket is formed on a pressure side of said airfoil portion.

* * * * *